US010230155B2

(12) United States Patent
Chih et al.

(10) Patent No.: US 10,230,155 B2
(45) Date of Patent: Mar. 12, 2019

(54) ANTENNA STRUCTURE AND WIRELESS COMMUNICATION DEVICE USING SAME

(71) Applicant: Chiun Mai Communication Systems, Inc., New Taipei (TW)

(72) Inventors: Jung-Sheng Chih, New Taipei (TW); Te-Chang Lin, New Taipei (TW); Wen-Chang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/655,922

(22) Filed: Jul. 21, 2017

(65) Prior Publication Data

US 2018/0026340 A1 Jan. 25, 2018

Related U.S. Application Data

(60) Provisional application No. 62/365,391, filed on Jul. 22, 2016, provisional application No. 62/365,342, filed on Jul. 21, 2016.

(30) Foreign Application Priority Data

Jul. 20, 2017 (CN) ..... 2017 1 0597799

(51) Int. Cl.
*H01Q 1/24* (2006.01)
*H01Q 1/38* (2006.01)
(Continued)

(52) U.S. Cl.
CPC ..... *H01Q 1/242* (2013.01); *H01Q 1/243* (2013.01); *H01Q 1/48* (2013.01); *H01Q 5/20* (2015.01);
(Continued)

(58) Field of Classification Search
CPC ..... H01Q 13/18; H01Q 1/24; H01Q 1/242; H01Q 1/48; H01Q 5/50; H01Q 1/243;
(Continued)

(56) References Cited

U.S. PATENT DOCUMENTS 4,023,179 A * 5/1977 Ikrath ..... H01Q 1/44 343/713
6,097,345 A * 8/2000 Walton ..... H01Q 1/1271 343/700 MS
(Continued)

FOREIGN PATENT DOCUMENTS

CN 105006647 A 10/2015

*Primary Examiner* — Tho G Phan
(74) *Attorney, Agent, or Firm* — ScienBiziP, P.C.

(57) ABSTRACT

An antenna structure includes a metallic member. The metallic member includes a front frame, a backboard, and a side frame. The side frame defines a slot. The front frame defines a first gap and a second gap. The front frame between the first gap and the second gap forms a radiating section. Current enters the radiating section from the first feed portion, the current flows through the radiating section and towards the first gap and the first radiating portion, thus activating radiating signals in a first frequency band; the current flows through the radiating section and towards the first ground portion, thus activating radiating signals in a second frequency band; the current flows through the radiating section and towards the second gap and the second radiating portion, thus activating radiation signals in a third different frequency band. A wireless communication device using the antenna structure is provided.

20 Claims, 22 Drawing Sheets

(51) Int. Cl.

| | |
|---|---|
| ***H01Q 13/18*** | (2006.01) |
| ***H01Q 1/48*** | (2006.01) |
| ***H01Q 5/50*** | (2015.01) |
| ***H01Q 5/20*** | (2015.01) |
| ***H01Q 5/335*** | (2015.01) |
| ***H01Q 5/35*** | (2015.01) |
| ***H01Q 5/371*** | (2015.01) |
| ***H01Q 5/378*** | (2015.01) |

(52) U.S. Cl.
CPC ..... *H01Q 5/335* (2015.01); *H01Q 5/35* (2015.01); *H01Q 5/371* (2015.01); *H01Q 5/378* (2015.01); *H01Q 5/50* (2015.01); *H01Q 13/18* (2013.01)

(58) Field of Classification Search
CPC ..... H01Q 21/28; H01Q 5/314; H01Q 5/371; H01Q 5/378; H01Q 5/335; H01Q 5/35; H01Q 9/42; H01Q 1/38
See application file for complete search history.

(56) References Cited

U.S. PATENT DOCUMENTS

| | | | | |
|---|---|---|---|---|
| 9,331,397 | B2 * | 5/2016 | Jin | H01Q 21/28 |
| 9,379,427 | B2 * | 6/2016 | Xu | H01Q 1/243 |
| 9,647,320 | B2 * | 5/2017 | Lin | H01Q 1/243 |
| 9,647,332 | B2 * | 5/2017 | Han | H01Q 1/50 |
| 10,008,763 | B2 * | 6/2018 | Huang | H01Q 1/243 |
| 2012/0299785 | A1 | 11/2012 | Bevelacqua | |
| 2015/0372372 | A1 | 12/2015 | Lee et al. | |

* cited by examiner

ANTENNA STRUCTURE AND WIRELESS COMMUNICATION DEVICE USING SAME

CROSS-REFERENCE TO RELATED APPLICATIONS

This application claims priority to U.S. Patent Application No. 62/365,342 filed on Jul. 21, 2016, U.S. Patent Application No. 62/365,391, filed on Jul. 22, 2016 and Chinese Patent Application No. 201710597799.0 filed on Jul. 20, 2017 the contents of which are incorporated by reference herein.

FIELD

The subject matter herein generally relates to an antenna structure and a wireless communication device using the antenna structure.

BACKGROUND

Metal housings, for example, metallic backboards, are widely used for wireless communication devices, such as mobile phones or personal digital assistants (PDAs). Antennas are also important components in wireless communication devices for receiving and transmitting wireless signals at different frequencies, such as wireless signals in Long Term Evolution Advanced (LTE-A) frequency bands. However, when the antenna is located in the metal housing, the antenna signals are often shielded by the metal housing. This can degrade the operation of the wireless communication device. Additionally, the metallic backboard generally defines slots or/and gaps thereon, which will affect an integrity and an aesthetic of the metallic backboard.

BRIEF DESCRIPTION OF THE DRAWINGS

Implementations of the present disclosure will now be described, by way of example only, with reference to the attached figures.

DETAILED DESCRIPTION

Figure 1:
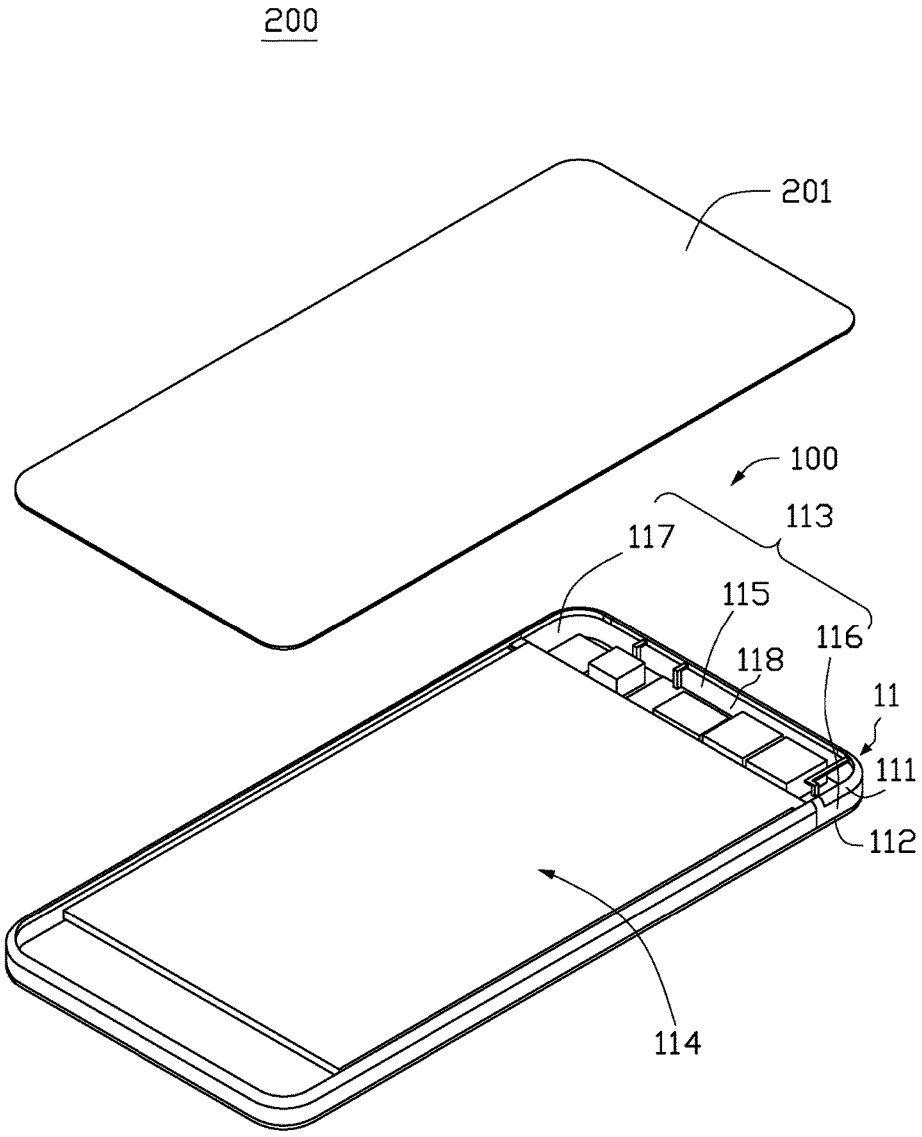
FIG. 1 is an isometric view of a first exemplary embodiment of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

FIG. 1 illustrates a first embodiment of a wireless communication device 200 using a first exemplary antenna structure 100. The wireless communication device 200 can be a mobile phone or a personal digital assistant, for example. The antenna structure 100 can receive or send wireless signals.

Figure 2:
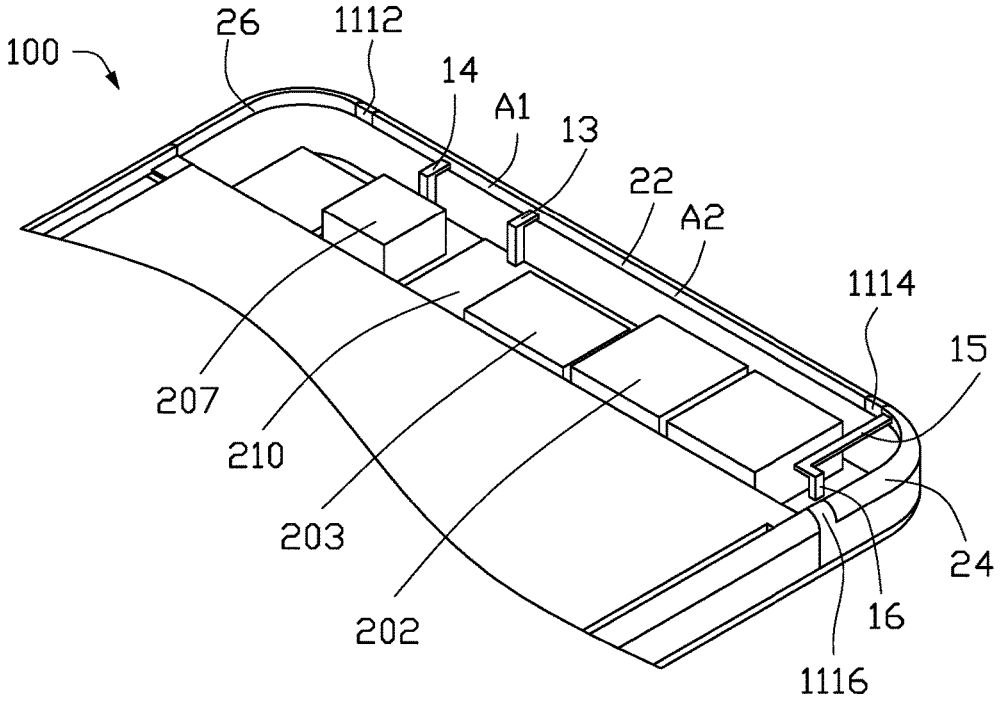
FIG. 2 is a detail view of the antenna structure of FIG. 1.
Figure 5:
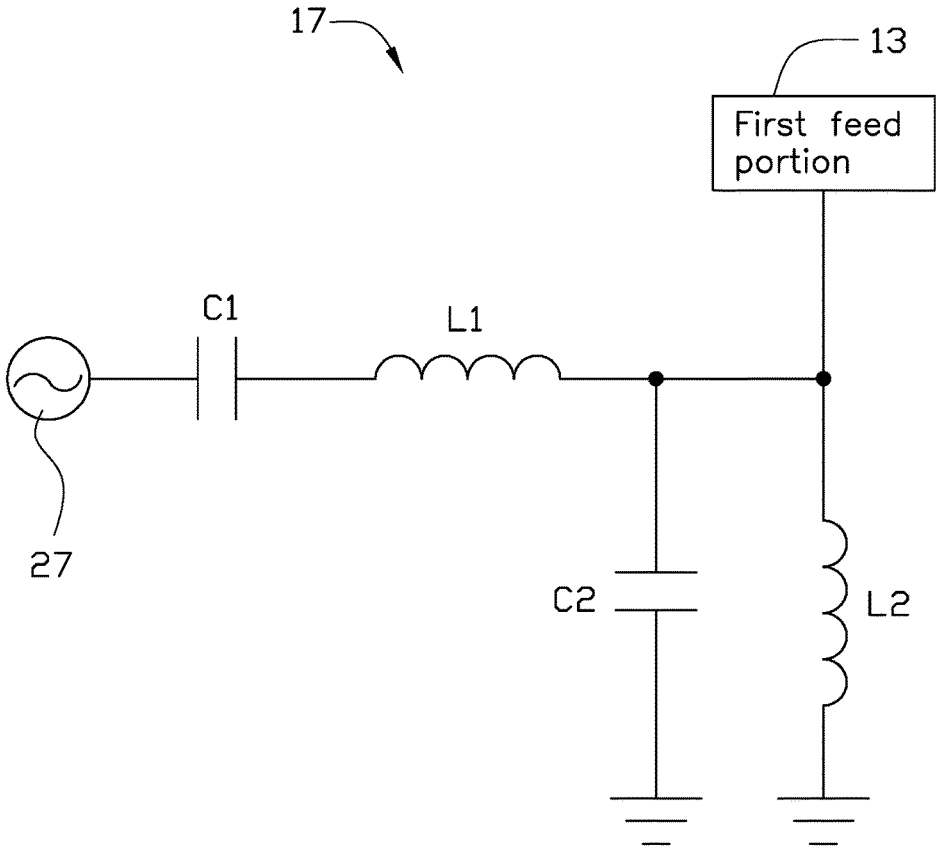
FIG. 5 is a circuit diagram of a first matching circuit of the antenna structure of FIG. 1.
Figure 6:
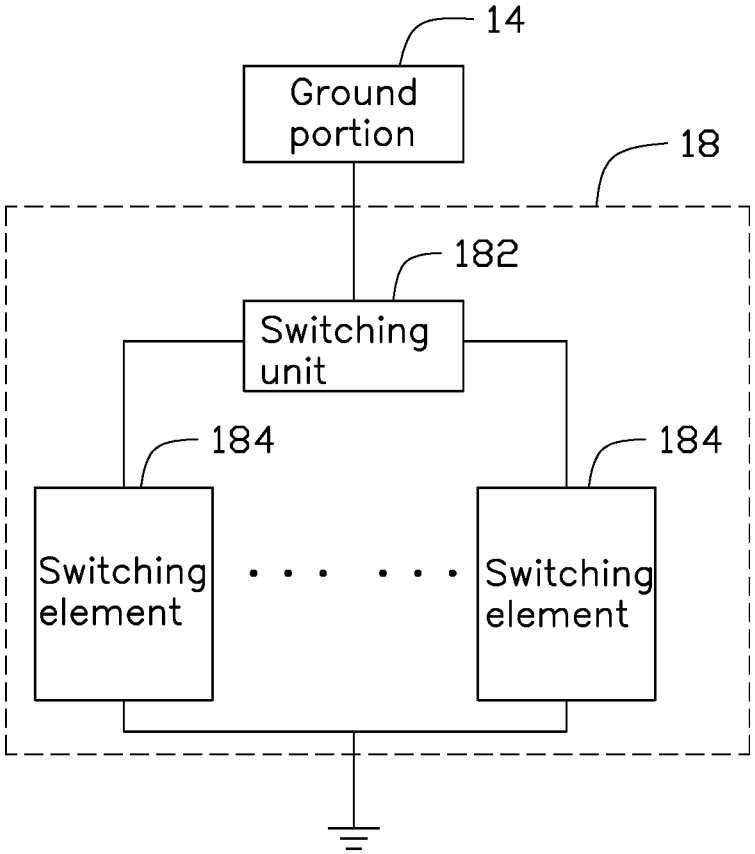
FIG. 6 is a circuit diagram of a switching circuit of the antenna structure of FIG. 1.
Figure 7:
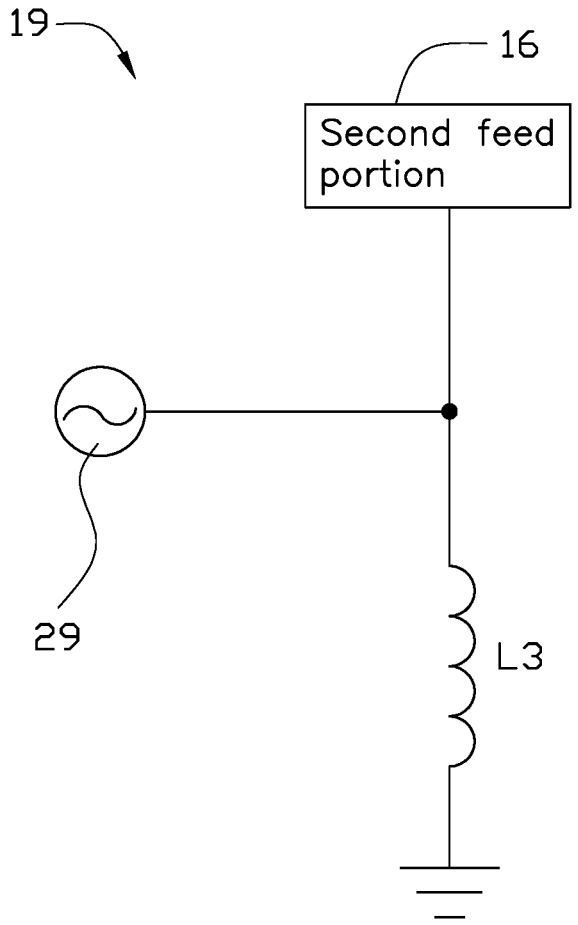
FIG. 7 is a circuit diagram of a second matching circuit of the antenna structure of FIG. 1.

Per FIG. 2, the antenna structure 100 includes a metallic member 11, a first feed portion 13, a ground portion 14, a radiating portion 15, a second feed portion 16, a first matching circuit 17 (shown in FIG. 5), a switching circuit 18 (shown in FIG. 6), and a second matching circuit 19 (shown in FIG. 7).

Per FIG. 1, the metallic member 11 can be a metal housing of the wireless communication device 200. In this exemplary embodiment, the metallic member 11 is a frame structure and includes a front frame 111, a backboard 112, and a side frame 113 as shown in FIG. 1. The front frame 111, the backboard 112, and the side frame 113 can be integral with each other. The front frame 111, the backboard 112, and the side frame 113 cooperatively form the metal housing of the wireless communication device 200. The front frame 111 defines an opening (not shown) thereon. The wireless communication device 200 includes a display 201. The display 201 is received in the opening. The display 201 has a display surface. The display surface is exposed at the opening and is positioned parallel to the backboard 112.

Figure 3:
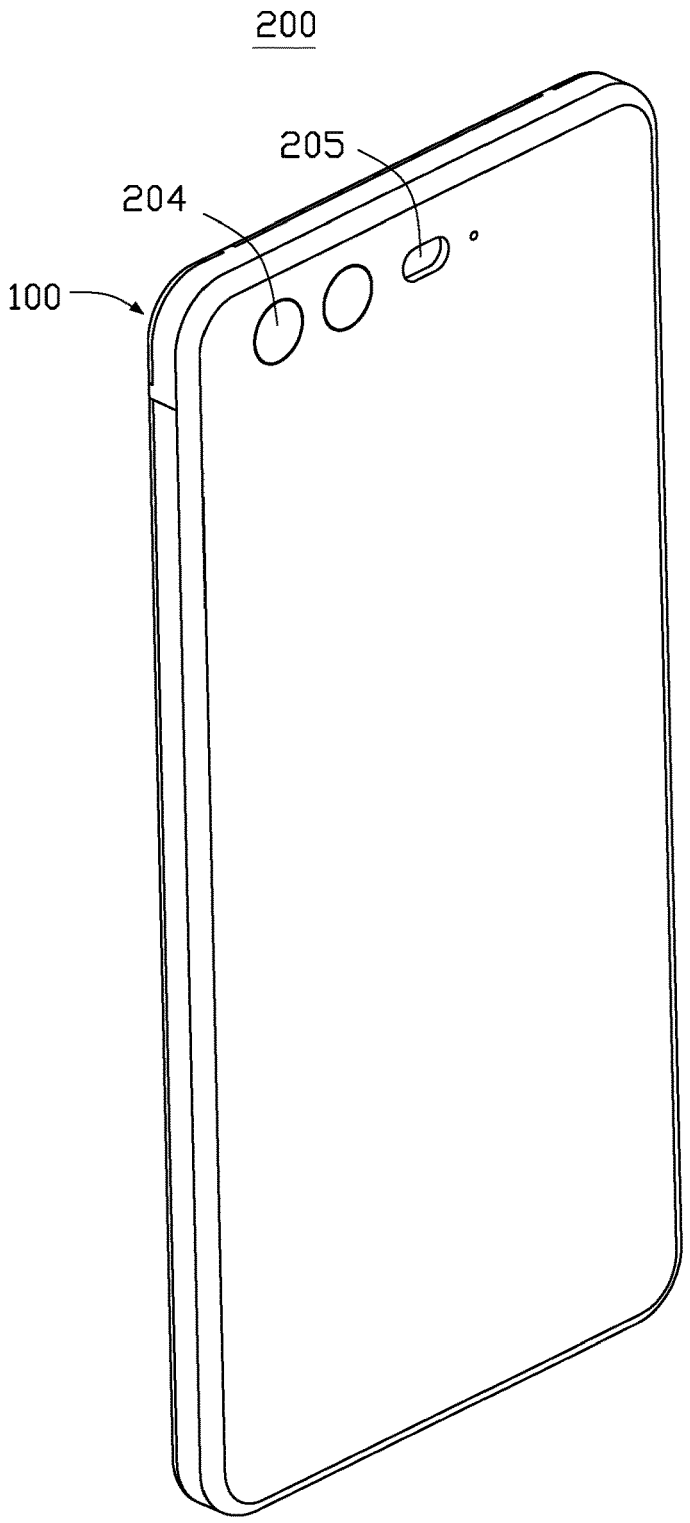
FIG. 3 is another isometric view of the wireless communication device of FIG. 1.

Per FIGS. 1 and 3, the backboard 112 is positioned opposite to the front frame 111. The backboard 112 is directly connected to the side frame 113, and there is no gap between the backboard 112 and the side frame 113. The backboard 112 is a single integrally formed metallic sheet. The backboard 112 defines the holes 204 and 205 for exposing double backside cameras 202 and a receiver 203. The backboard 112 does not define any slot, break line, or gap that divides the backboard 112. The backboard 112 serves as a ground of the antenna structure 100.

The side frame 113 is positioned between the front frame 111 and the backboard 112. The side frame 113 is positioned around a periphery of the front frame 111 and a periphery of the backboard 112. The side frame 113 forms a receiving space 114 together with the display 201, the front frame 111, and the backboard 112. The receiving space 114 can receive a print circuit board 210, a processing unit (not shown), or other electronic components or modules. In this exemplary embodiment, the electronic components or modules at least include the double backside cameras 202, the receiver 203, and a front camera 207. The double backside cameras 202, the receiver 203, and the front camera 207 are arranged on the print circuit board 210 and spaced apart from each other.

Referring to FIG. 1, the side frame 113 includes a top portion 115, a first side portion 116, and a second side portion 117. The top portion 115 connects the front frame 111 and the backboard 112. The first side portion 116 is spaced apart from and parallel to the second side portion 117. The top portion 115 has first and second ends. The first side portion 116 is connected to the first end of the first frame 111 and the second side portion 117 is connected to the second end of the top portion 115. The first side portion 116 connects the front frame 111 and the backboard 112. The second side portion 117 also connects the front frame 111 and the backboard 112. The side frame 113 defines a slot 118. In this exemplary embodiment, the slot 118 is defined at the top portion 115 and extends to the first side portion 116 and the second side portion 117. In other exemplary embodiments, the slot 118 can only be defined at the top portion 115 and does not extend to any one of the first side portion 116 and the second side portion 117. In other exemplary embodiments, the slot 118 can be defined only at the top portion 115, but not extending to any of the first side portion 116 and the second side portion 117. In other exemplary embodiments, the slot 118 can be defined at the top portion 115 and extends to one of the first side portion 116 and the second side portion 117.

Referring to FIGS. 1 and 2, the front frame 111 includes a top arm (not labeled) corresponding to the top portion 115 and two side arms (not labeled) corresponding to the first side portion 116 and the second side portion 117. The front frame 111 defines a first gap 1112 and a second gap 1114 at the top arm and a third gap 1116 at the side arm corresponding to the first side portion 116. The third gap 1116 is on an end of the slot 118. The gaps 1112, 1114, 1116 are in communication with the slot 118 and extend across the front frame 111. A portion of the front frame 111 is divided by the gaps 1112, 1114, 1116 into three portions, which are a first radiating section 22, a second radiating section 24, and a third radiating section 26. A portion of the front frame 111 between the first gap 1112 and the second gap forms the first radiating section 22. In this exemplary embodiment, the first gap 1112 and the second gap 1114 are defined on the top arm of the front frame 111. The first gap 1112 and the second gap 1114 are respectively disposed adjacent to corners on opposite ends of the top arm, the first radiating section 22 is a straight arm. The second radiating section 24 is formed between the second gap 1114 and the third gap 1116, extends from the top arm to a side arm of the front frame 111, and crosses an arc corner. The third radiating section 26 is formed between the first gap 1112 and the other end of the slot 118 away from the third gap 1116, extends from the top arm to another arm of the front frame 111, and crosses another arc corner. In this exemplary embodiment, the slot 118 and the gaps 1112, 1114, 1116 are filled with insulating material, for example, plastic, rubber, glass, wood, ceramic, or the like, thereby isolating the first radiating section 22, the second radiating section 24, the third 1116, and the backboard 112.

In this exemplary embodiment, except for the slot 118 and the gaps 1112, 1114, 1116, an upper half portion of the front frame 111 and the side frame 113 does not define any other slot, break line, and/or gap. That is, there are only the gaps 1112, 1114, 1116 defined on the upper half portion of the front frame 111.

Referring to FIG. 2, one end of the first feed portion 13 is electrically connected to an end the first radiating section 22 adjacent to the first gap 1112, the other end electrically connects to a feed source 27 (shown in FIG. 5) through the first matching circuit 17, thus the first feed portion 13 feeds in current for the first radiating section 22. In this exemplary embodiment, after the current is fed into the first feed portion 13, the current flows towards the first gap 1112 and the second gap 1114 along the first radiating section 22. Thus, the first radiating section 22 is divided into a short portion A1 and a long portion A2 by a connecting point of the first feed portion 13. The short portion A1 extends towards the first gap 1112 and the long portion A2 extends towards the second gap 1114 from the connecting point of the first feed portion 13. In this exemplary embodiment, the connecting point of the first feed portion 13 is not positioned at a middle portion of the first radiating section 22. The long portion A2 is longer than the short portion A1. One end of the ground portion 14 electrically connects to the short portion A1, the other end connects to the ground through the switching circuit 18. The first feed portion 13 and the ground portion 14 are both substantially L-shaped and spaced apart from each other.

The first matching circuit 17 is arranged on the printed circuit board 210. Per FIG. 5, the first matching circuit 17 includes a first inductor L1, a first capacitor C1, a second inductor L2, and a second capacitor C2. One end of the first inductor L1 electrically connects to the first feed portion 13, the other end electrically connects to the feed source 27 through the first capacitor C1. One end of the second inductor L2 is electrically connected between the first feed portion 13 and the first inductor L1, the other end electrically connects to the ground. One end of the second capacitor C2 is electrically connected between the first inductor L1 and the second inductor L2, the other end electrically connects to the ground. In this exemplary embodiment, an inductance of the first inductor L1 can be 1.5 nanohenry (nH), a capacitance of the first capacitor C1 can be 1.2 picofarad (pF), an inductance of the second inductor L2 can be 10 nH, a capacitance of the second capacitor C2 can be 0.8 pF.

The switching circuit 18 is arranged on the printed circuit board 210. Per FIG. 6, one end of the switching circuit 18 electrically connects to the ground portion 14, the other end electrically connects to the ground. The switching circuit 18 includes a switching unit 182 and a plurality of switching elements 184. The switching unit 182 is electrically connected to the ground portion 14. The switching elements 184 can be an inductor, a capacitor, or a combination of the inductor and the capacitor. The switching elements 184 are connected in parallel to each other. One end of each switching element 184 is electrically connected to the switching unit 182. The other end of each switching element 184 is electrically connected to the ground. Through controlling the switching unit 182, the short portion A1 can be switched to connect with different switching elements 184. Each switching element 184 has a different impedance.

The feed portion 13 feeds current into the first radiating section 22 from the feed source 27 through the first matching circuit 17. The current flows through the short portion A1 and towards the first gap 1112, thus activating a first mode to generate radiation signals in a first frequency band. In this exemplary embodiment, the first mode is an LTE-A (Long Term Evolution Advanced) middle frequency operation mode and an LTE-A middle frequency operation mode, the first frequency band is a frequency band of about 1710-2170 MHz. The feed portion 13 feeds current into the first radiating section 22 from the feed source 27 through the first matching circuit 17, the current flows through the long portion A2 and towards the second gap 1114, thus activating a second mode to generate radiation signals in a second frequency band. In this exemplary embodiment, the second mode is an LTE-A low frequency operation mode, the second frequency band is a frequency band of about 700-960 MHz.

The radiating portion 15 is substantially L-shaped, one end of the radiating portion 15 perpendicularly connects to the second radiating section 24 and is adjacent to the second gap 1114, the other end perpendicularly connects to one end of the second feed portion 16. The other end of the second feed portion 16 electrically connects to the feed source 29 through the second matching circuit 19.

The second matching circuit 19 is arranged on the printed circuit board 210. Per FIG. 6, the second matching circuit 19 includes a third inductor L3. One end of the third inductor L3 electrically connects to the second feed portion 16, the other end electrically connects to the ground. The feed source 29 is electrically connected between the second feed portion 16 and the third inductor L3. In this exemplary embodiment, an inductance of the third inductor L3 can be 1.8 nH. The second feed portion 16 feeds current into the radiating portion 15 from the feed source 29 through the second matching circuit 19, the current flows through the radiating portion 15 and the second radiating section 24, and towards the third gap 1116, thus activating a third mode to generate radiation signals in a third frequency band. In this exemplary embodiment, the third mode is a GPS mode, the third frequency band is a frequency band of about 1575 MHz.

The third radiating section 26 obtains current from the short portion A1 by coupling, the current flows through the third radiating section 26, thus activating a fourth mode to generate radiation signals in a fourth frequency band. In this exemplary embodiment, the fourth mode is an LTE-A high frequency operation mode, the fourth frequency band is a frequency band of about 2300-2690 MHz.

Through controlling the switching unit 182, the first radiating section 22 can be switched to connect with different switching elements 184. Since each switching element 184 has a different impedance, an operating frequency band of the first radiating section 22 can be adjusted through switching the switching unit 182, for example, the first frequency band of the first radiating section 22 and the fourth frequency band of the third radiating section 26 can be offset towards a lower frequency or towards a higher frequency (relative to each other). In this exemplary embodiment, when the switching unit 182 is switched to a switching element with an inductance of 25 nH, the antenna structure 100 may operates at the low frequency band 704-746 MHz and the high frequency band 1710-2690 MHz. When the switching unit 182 is switched to a switching element with an inductance of 18 nH, the antenna structure 100 may operates at the low frequency band 746-787 MHz. When the switching unit 182 is switched to a switching element with an inductance of 7.5 nH, the antenna structure 100 may operates at the low frequency band 850 MHz. When the switching unit 182 is switched to a switching element with an inductance of 3.6 nH, the antenna structure 100 may operates at the low frequency band 900 MHz.

The first feed portion 13 is between the receiver 203 and the front camera 207. The ground portion 14 is between the short portion A1 and the front camera 207. The radiating portion 15 and the second feed portion 16 are between the double backside cameras 202 and the second radiating section 24.

The backboard 112 serves as the ground of the antenna structure 100. Perhaps, a middle frame or a shielding mask (not shown) also may serves as the ground of the antenna structure 100, the middle frame can be a shielding mask for shielding electromagnetic interference arranged on the display 201 facing the backboard 112. The shielding mask or the middle frame can be made of metal material. The shielding mask or the middle frame may connect to the backboard 112 to form a greater ground for the antenna structure 100. In summary, each ground portion directly or indirectly connects to the ground.

In this exemplary embodiment, to obtain preferred antenna characteristics, a width of the slot 118 can be 3.83 millimeter, that is a distance from the backboard 112 to the first radiating section 22, the second radiating section 24, and third radiating section 26 can be 3.83 millimeter, the width of the slot 118 can be adjusted from 3 to 4.5 millimeter, thus to improve antenna characteristic for the radiating sections by being spaced apart from the backboard 112. A width of each of the gaps 1112, 1114, 1116 can be 2 millimeter and can be adjusted from 1.5 to 2.5 millimeter, which may further improve antenna characteristic for the radiating sections. A thickness of the front frame 111 can be 1.5 millimeter, that is a thickness of the gaps 1112, 1114, 1116 can be 1.5 millimeter.

Figure 4:
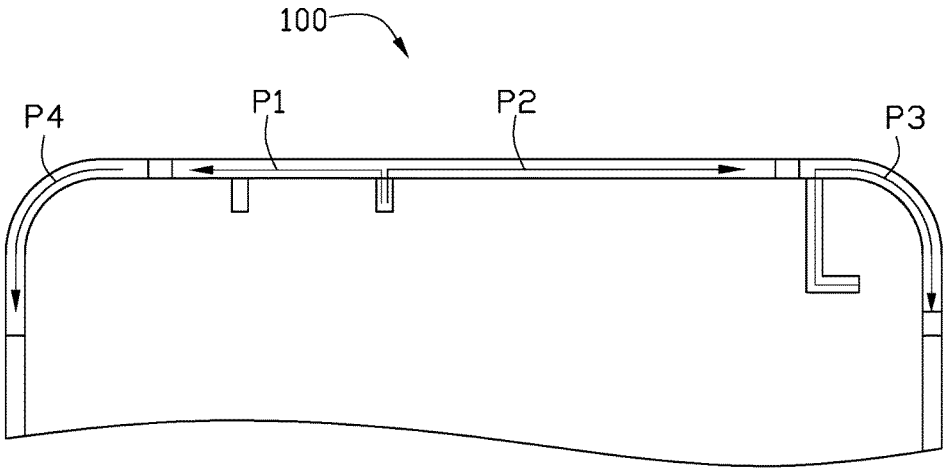
FIG. 4 is a current path distribution graph when the antenna structure of FIG. 1 is in operation.

Per FIG. 4, when the current enters the first radiating section 22 from the feed portion 13, the current flows towards two direction, one direction flows through the short portion A1 and towards the first gap 1112 (please see a path P1), thus activating the LTE-A middle frequency operation mode. The current in the first radiating section 22 flows through the long portion A2 and towards the second gap 1114 (please see a path P2), thus, activating the LTE-A low frequency operation mode, a direction of the path P1 is opposite to a direction of the path P2. When the current enters the radiating portion 15 from the second feed portion 16, the current flows the radiating portion 15 and the second radiating section 24, and towards the third gap 1116 (please see a path P3), thus activating the GPS mode. The third radiating section 26 obtains current from the short portion A1 by coupling, the current flows through the third radiating section 26 (please see a path P4), thus, activating the LTE-A high frequency operation mode.

Figure 8:
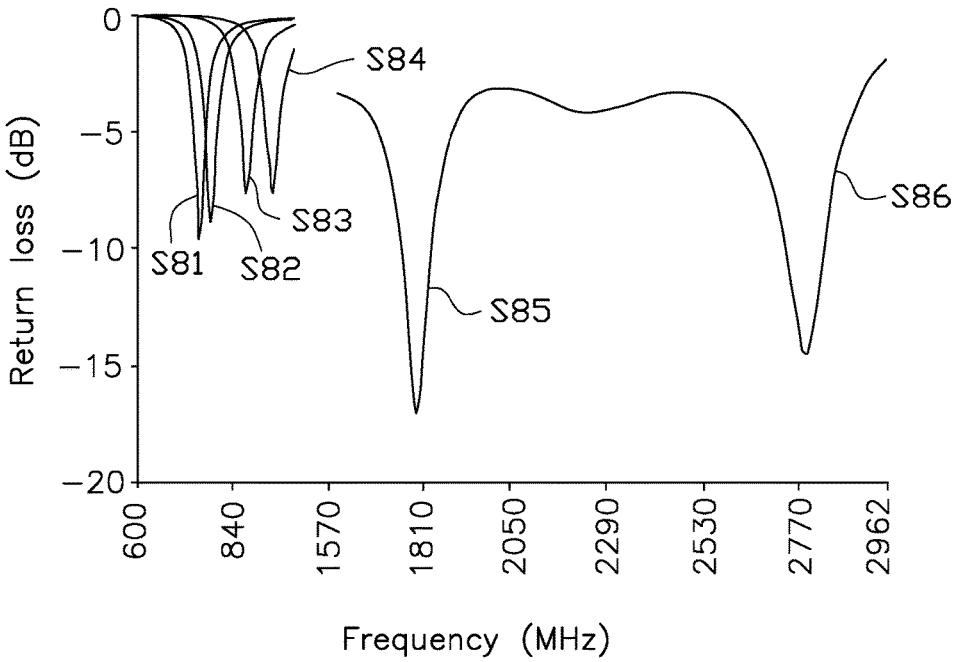
FIG. 8 is a return loss (RL) graph when a first radiating section and a third radiating section of the antenna structure of FIG. 1 is in operation.

FIG. 8 illustrates a return loss (RL) graph of the first radiating section 22 and the third radiating section 26 of the antenna structure 100 in operation. Curve S81 illustrates a return loss of the first radiating section 22 operates at the LTE-A low frequency band of 704-746 MHz. Curve S82 illustrates a return loss of the first radiating section 22 operates at the LTE-A low frequency band of 746-787 MHz. Curve S83 illustrates a return loss of the first radiating section 22 operates at the LTE-A low frequency band of 850 MHz. Curve S84 illustrates a return loss of the first radiating section 22 operates at the LTE-A low frequency band of 900 MHz. The switching circuit 18 may adjust the frequency band and thus different curves are presented. Curve S85 illustrates a return loss of the first radiating section 22 and the third radiating section 26 operate at the LTE-A middle frequency band of 1710-2170 MHz. Curve S86 illustrates a return loss of the first radiating section 22 and the third radiating section 26 operate at the LTE-A high frequency band of 1850-2690 MHz.

Figure 9:
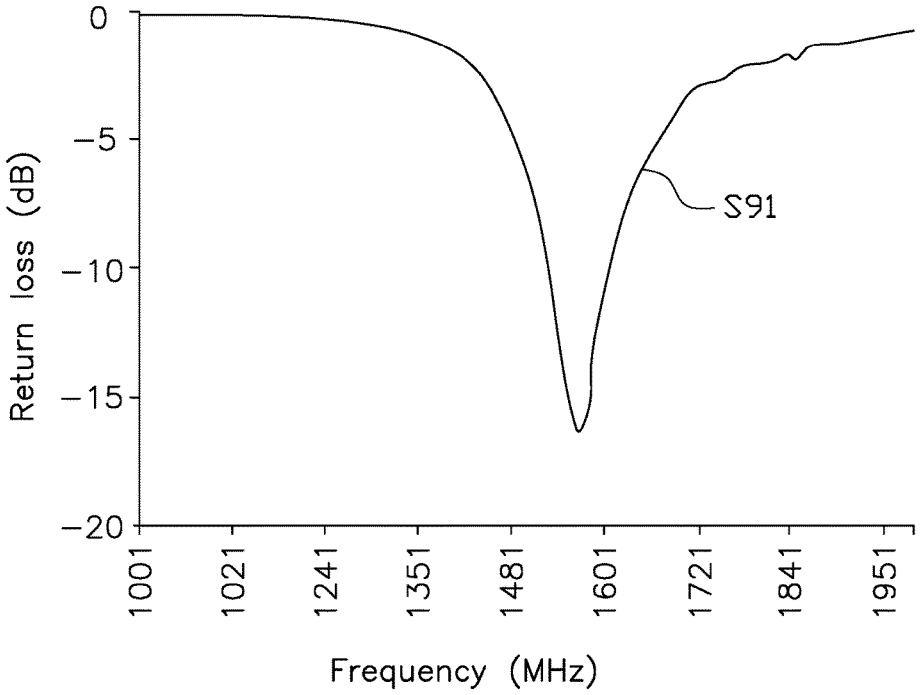
FIG. 9 is a return loss (RL) graph when a second radiating section of the antenna structure of FIG. 1 in operation.

FIG. 9 illustrates a return loss (RL) graph of the second radiating section 24 of the antenna structure 100 in operation. Curve S91 illustrates a return loss of the second radiating section 24 operates at the GPS frequency band of 1575 MHz.

Figure 10:
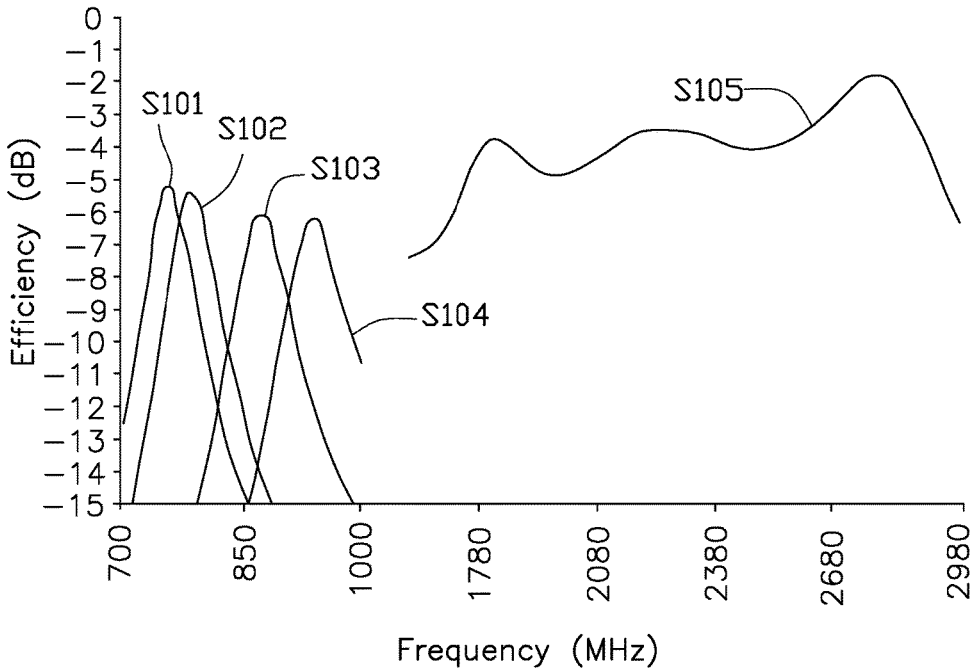
FIG. 10 is a radiating efficiency graph when the first radiating section and the third radiating section of the antenna structure of FIG. 1 in operation.

FIG. 10 illustrates a radiating efficiency graph of the first radiating section 22 and the third radiating section 24 of the antenna structure 100 in operation. Curve S81 illustrates a radiating efficiency of the first radiating section 22 operates at the LTE-A low frequency band of 704-746 MHz. Curve S82 illustrates a radiating efficiency of the first radiating section 22 operates at the LTE-A low frequency band of 746-787 MHz. Curve S83 illustrates a radiating efficiency of the first radiating section 22 operates at the LTE-A low frequency band of 850 MHz. Curve S84 illustrates a radiating efficiency of the first radiating section 22 operates at the LTE-A low frequency band of 900 MHz. The switching circuit 18 may adjust the frequency band and thus different curves are presented. Curve S85 illustrates a radiating efficiency of the first radiating section 22 and the third radiating section 26 operate at the LTE-A middle frequency band of 1710-2170 MHz and the LTE-A high frequency band of 1850-2690 MHz.

Figure 11:
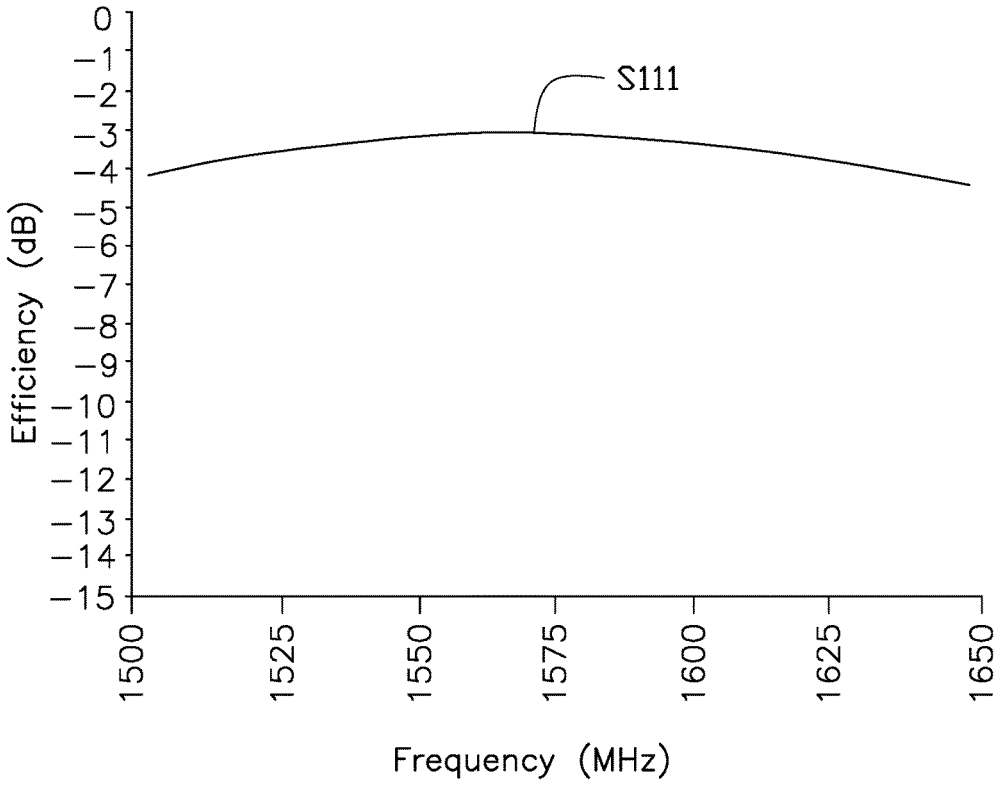
FIG. 11 is a radiating efficiency graph when the second radiating section of the antenna structure of FIG. 1 in operation.

FIG. 11 illustrates a radiating efficiency graph of the second radiating section 24 of the antenna structure 100 in operation. Curve S91 illustrates a radiating efficiency of the second radiating section 24 operates at the GPS frequency band of 1575 MHz.

Per FIGS. 8 to 11, the antenna structure 100 can work at a low frequency band, for example, LTE-A low frequency band (700-960 MHz), at a middle frequency band (1710-2170 MHz), and at high frequency bands (2300-2690 MHz). The antenna structure 100 can also work at the GPS frequency band (1575 MHz). That is, the antenna structure 100 can work at the low frequency band, the middle frequency band, and the high frequency band. When the antenna structure 100 operates at these frequency bands, a working frequency satisfies a design of the antenna and also has a good radiating efficiency.

The antenna structure 100 includes the metallic member 11 and the backboard 112. The metallic member 11 defines the slot on the side frame 113 and the gaps on the front frame 111. The backboard 112 is an integrally formed metallic sheet without other slot, break line, and/or gap, which maintains integrity and aesthetics.

Figure 12:
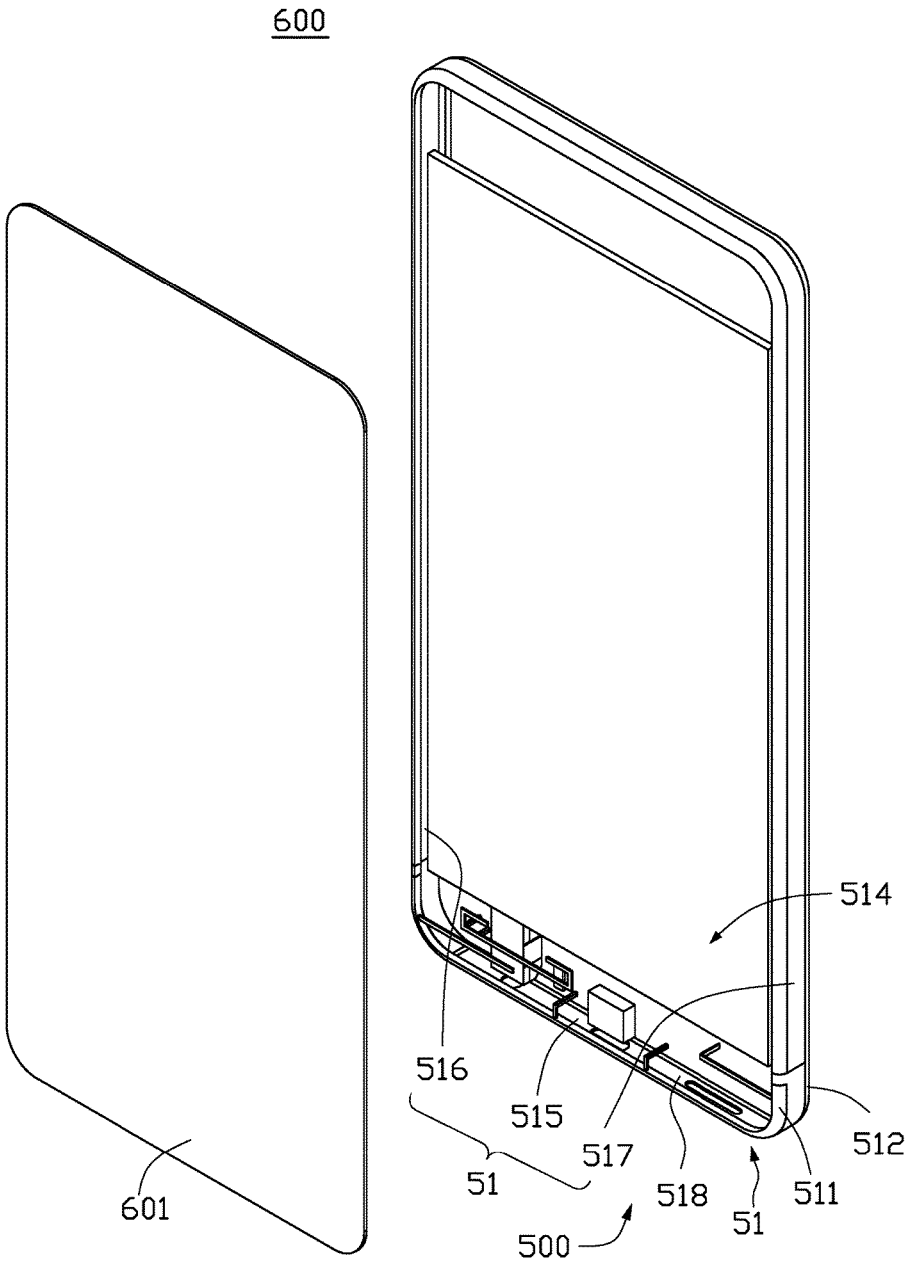
FIG. 12 is an isometric view of a second exemplary embodiment of a wireless communication device using a second exemplary antenna structure.

FIG. 12 illustrates a second embodiment of a wireless communication device 600 using a second exemplary antenna structure 500. The wireless communication device 600 can be a mobile phone or a personal digital assistant, for example. The antenna structure 500 can receive or send wireless signals.

Figure 13:
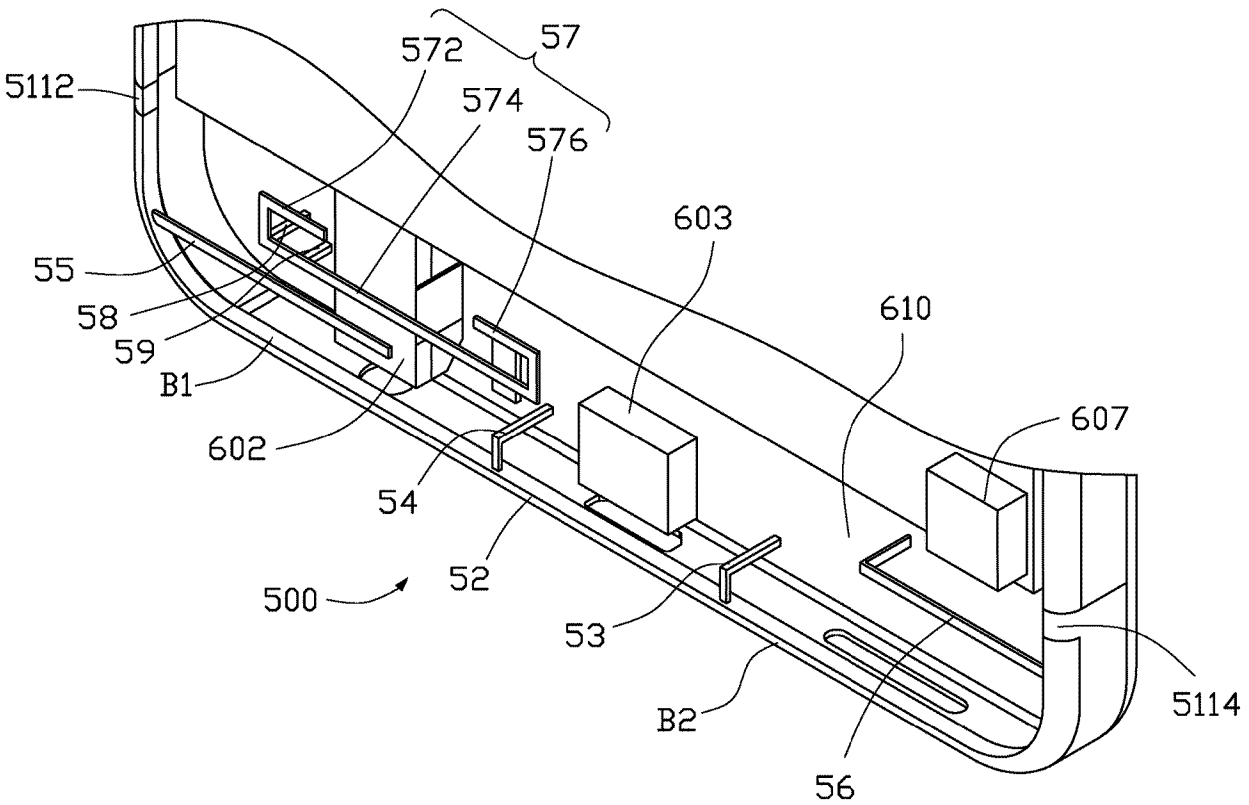
FIG. 13 is detailed view of the antenna structure of the wireless communication device of FIG. 15.
Figure 14:
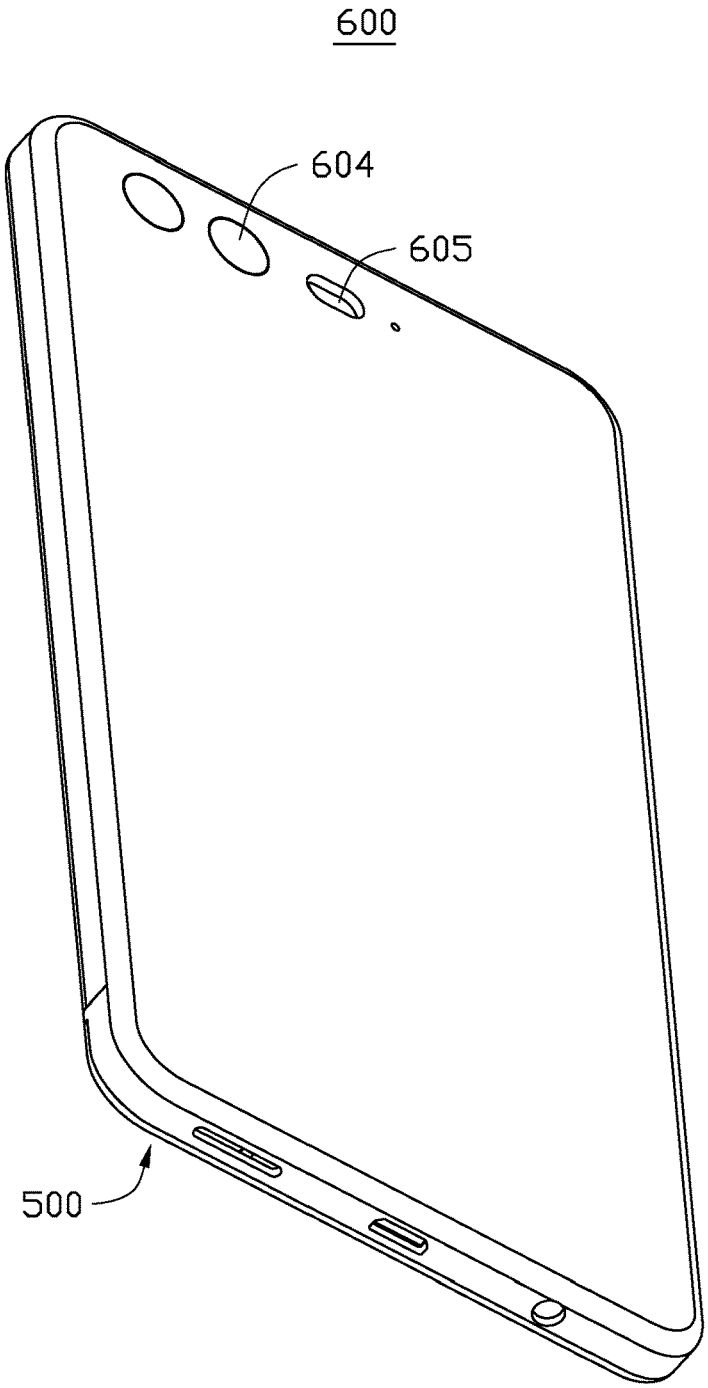
FIG. 14 is another isometric view of the wireless communication device of FIG. 12.
Figure 21:
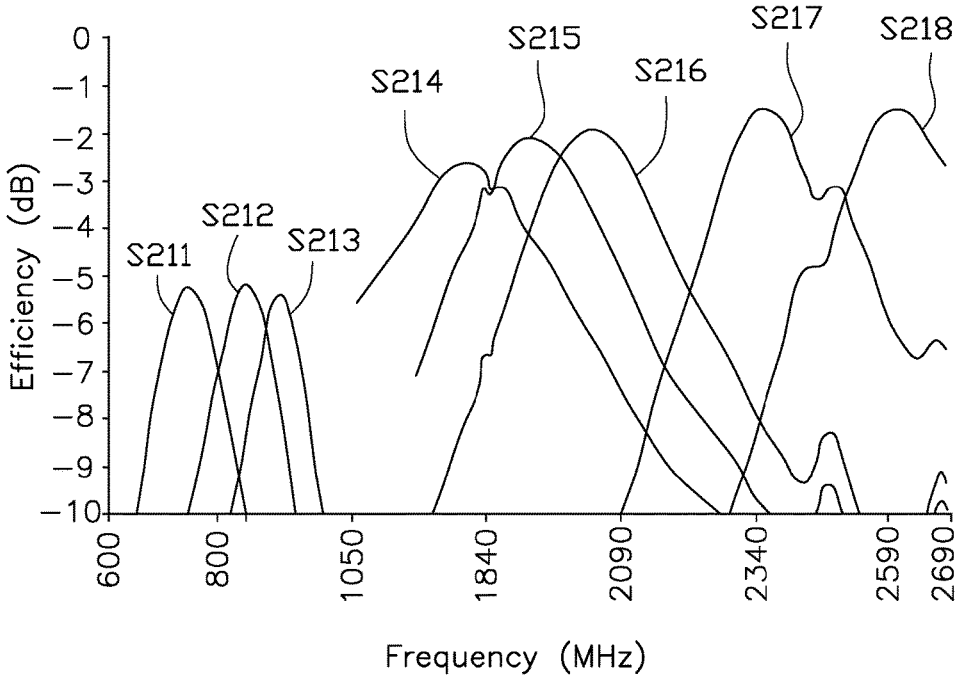
FIG. 21 is a radiating efficiency graph when the antenna structure of FIG. 12 operates at the LTE-A low frequency band, the LTE-A middle frequency band, and the LTE-A high frequency band.

Per FIGS. 12 and 13, the antenna structure 500 includes a metallic member 51, a first feed portion 53, a first ground portion 54, a first radiating portion 55, a second radiating portion 56, a third radiating portion 57, a second feed portion 58, a second ground portion 59, a matching circuit 62 (shown in FIG. 16), a first switching circuit 64 (shown in FIG. 17), and a second switching circuit 66 (shown in FIG. 21).

The metallic member 51 can be a metal housing of the wireless communication device 600. In this exemplary embodiment, the metallic member 51 is a frame structure and includes a front frame 511, a backboard 512, and a side frame 513. The front frame 511, the backboard 512, and the side frame 513 can be integral with each other. The front frame 511, the backboard 512, and the side frame 513 cooperatively form the metal housing of the wireless communication device 600. The front frame 511 defines an opening (not shown) thereon. The wireless communication device 600 includes a display 601. The display 601 is received in the opening. The display 601 has a display surface. The display surface is exposed at the opening and is positioned parallel to the backboard 512.

The backboard 512 is positioned opposite to the front frame 511. The backboard 512 is directly connected to the side frame 513, and there is no gap between the backboard 512 and the side frame 513. The backboard 512 is a single integrally formed metallic sheet. The backboard 512 defines holes for exposing double backside cameras and a receiver. The backboard 512 does not define any slot, break line, or gap that divides the backboard 512. The backboard 512 serves as a ground of the antenna structure 500.

The side frame 513 is positioned between the front frame 511 and the backboard 512. The side frame 513 is positioned around a periphery of the front frame 511 and a periphery of the backboard 512. The side frame 513 forms a receiving space 514 together with the display 601, the front frame 511, and the backboard 512. The receiving space 514 can receive a print circuit board 610, a processing unit, or other electronic components or modules. In this exemplary embodiment, the electronic components or modules at least include an audio jack 602 and a USB connector 603. The audio jack 602 and the USB connector 603 are arranged on the print circuit board 610 and spaced apart from each other.

The side frame 513 includes a bottom portion 515, a first side portion 516, and a second side portion 517. The bottom portion 515 connects the front frame 511 and the backboard 512. The first side portion 516 is spaced apart from and parallel to the second side portion 517. The bottom portion 515 has first and second ends. The first side portion 516 is connected to the first end of the first frame 311 and the second side portion 517 is connected to the second end of the bottom portion 515. The first side portion 516 connects the front frame 511 and the backboard 512. The second side portion 517 also connects the front frame 511 and the backboard 512. The side frame 513 defines a slot 518. In this exemplary embodiment, the slot 518 is defined at the bottom portion 515 and extends to the first side portion 516 and the second side portion 517. In other exemplary embodiments, the slot 518 can only be defined at the bottom portion 515 and does not extend to any one of the first side portion 516 and the second side portion 517. In other exemplary embodiments, the slot 518 can be defined only at the bottom portion 515, but not extending to any of the first side portion 516 and the second side portion 517. In other exemplary embodiments, the slot 518 can be defined at the bottom portion 515 and extends to one of the first side portion 516 and the second side portion 517.

The front frame 511 includes a bottom arm (not labeled) corresponding to the bottom portion 515 and two side arms (not labeled) corresponding to the first side portion 516 and the second side portion 517. The front frame 511 defines a first gap 5112 and a second gap 5114 at the two side arms, respectively. The gaps 5112, 5114 are in communication with the slot 518 and extend across the front frame 511. A portion of the front frame 511 between the first gap 3112 and the second gap 3114 forms a radiating section 52. In this exemplary embodiment, the first gap 5112 and the second gap 5114 are at two opposite ends of the slot 518. In this exemplary embodiment, the slot 518 and the gaps 5112, 5114 are filled with insulating material, for example, plastic, rubber, glass, wood, ceramic, or the like, thereby isolating the radiating section 52 and the backboard 512.

In this exemplary embodiment, except for the slot 518 and the gaps 5112, 5114, a lower half portion of the front frame 511 and the side frame 513 does not define any other slot, break line, and/or gap. That is, there are only the gaps 5112, 5114 defined on the lower half portion of the front frame 511.

Figure 16:
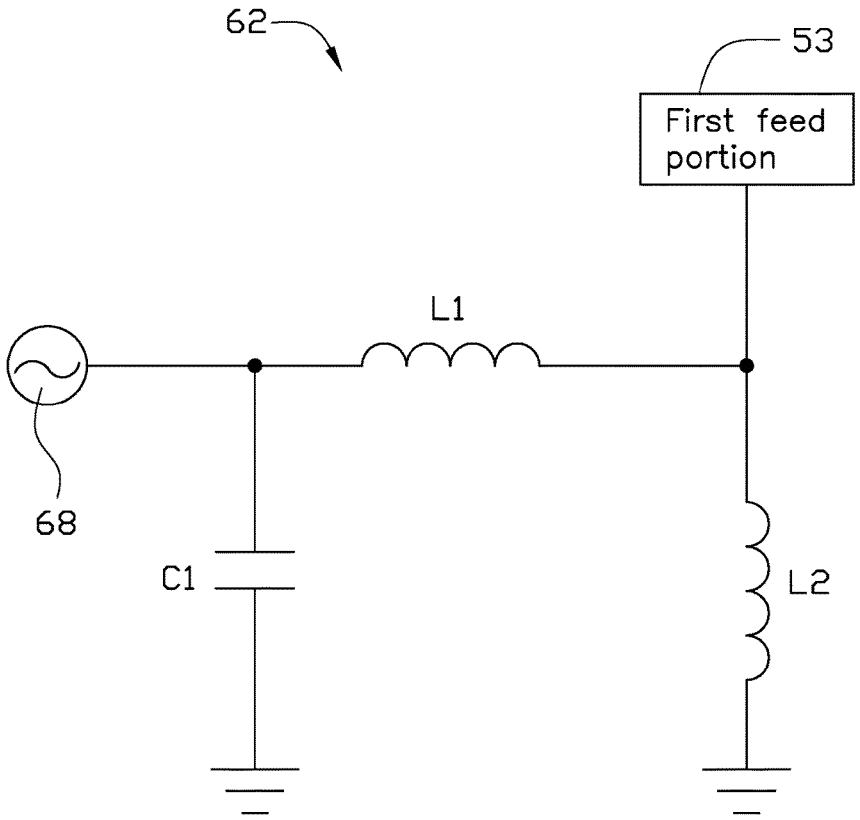
FIG. 16 is a circuit diagram of a matching circuit of the antenna structure of FIG. 12.
Figure 17:
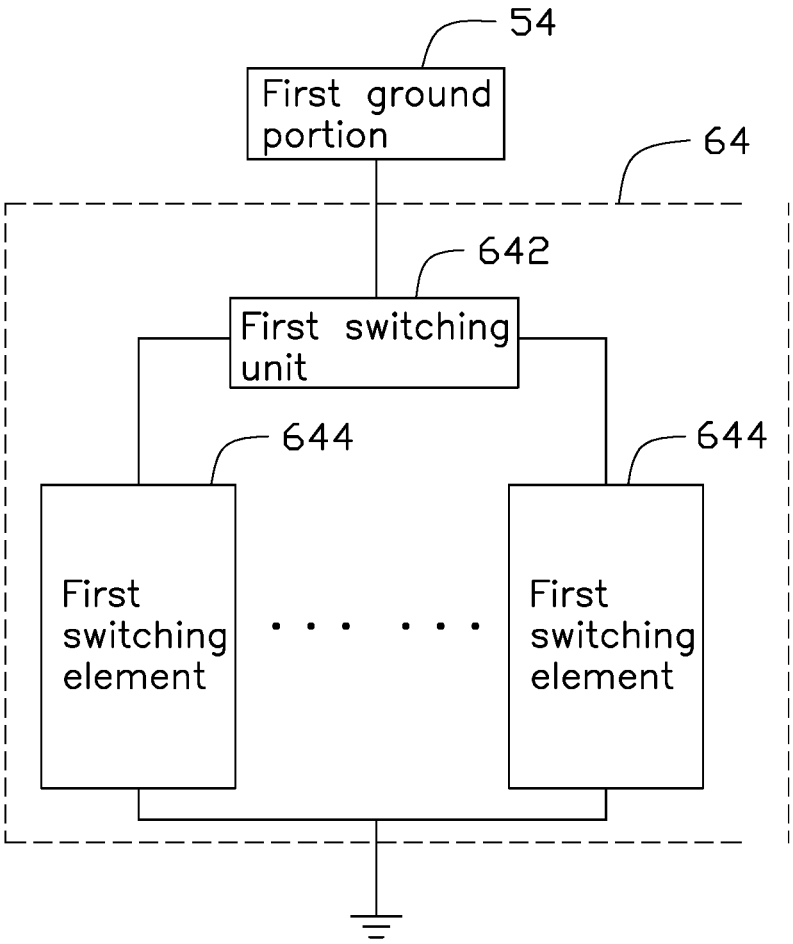
FIG. 17 is a circuit diagram of a first switching circuit of the antenna structure of FIG. 12.

One end of the first feed portion 53 connects to the radiating section 52 and is adjacent to the second gap 5114, the other end electronically connects to a feed source 68 through the matching circuit 62 (shown in FIG. 16). Thus, the feed source 68 feeds current into the radiating section 52 through the matching circuit 62 and the first feed portion 53. In this exemplary embodiment, after the current is fed into the first feed portion 53, the current flows towards the first gap 5112 and the second gap 5114 along the radiating section 52. Thus, the radiating section 52 is divided into a long portion B1 and a short portion B2. The long portion B1 extends towards the first gap 5112 and the short portion B2 extends towards the second gap 5114 from the connecting point of the first feed portion 53. In this exemplary embodiment, the connecting point of the first feed portion 53 is not positioned at a middle portion of the radiating section 52. The long portion B1 is longer than the short portion B2.

The matching circuit 62 is arranged on the printed circuit board 610. Per FIG. 16, the matching circuit 62 includes a first capacitor C1, a first inductor L1, and a second inductor L2. One end of the first inductor L1 electrically connects to the first feed portion 53, the other end electrically connects to the feed source 68. One end of the second inductor L2 is electrically connected between the first inductor L1 and the first feed portion 53, the other end electrically connects to the ground. One end of the first capacitor C1 is electrically connected between the first inductor L1 and the feed source 68, the other end electrically connects to the ground. In this exemplary embodiment, a capacitance of the first capacitor C1 can be 1 picofarad (pF), an inductance of the first inductor L1 can be 0.5 nanohenry (nH), and an inductance of the second inductor L2 can be 8.2 nH.

Per FIG. 13, the first ground portion 54 is spaced apart from the first feed portion 53. One end of the first ground portion 54 electrically connects to the long portion B1, the other end electrically connects to the ground through the first switching circuit 64. Per FIG. 17, the first switching circuit 64 includes a first switching unit 642 and a plurality of first switching elements 644. The first switching unit 642 is electrically connected to the first ground portion 54. The first switching elements 644 can be an inductor, a capacitor, or a combination of the inductor and the capacitor. The first switching elements 644 are connected in parallel to each other. One end of each switching element 644 is electrically connected to the first switching unit 642. The other end of each switching element 644 is electrically connected to the ground. Through controlling the first switching unit 642, the long portion B1 can be switched to connect with different first switching elements 644. Each first switching element 644 has a different impedance.

The first radiating portion 55 electrically connects to the long portion B1 and is adjacent to the first gap 5112. In this exemplary embodiment, the first radiating portion 55 is substantially a straight arm. The first radiating portion 55 electrically connects to a side arm of the front frame 511 defining the first gap 5112 and is parallel to the bottom arm of the front frame 511.

One end of the second radiating portion 56 electrically connects to the short portion B2 and is adjacent to the second gap 5114, the other end electrically connects to the ground through the second switching circuit 66. In this exemplary embodiment, the second radiating portion 56 is substantially L-shaped and connects to the side arm of the front frame 511 defining the second gap 5114 and is parallel to the bottom arm of the front frame 511. The first radiating portion 55, the first ground portion 54, the first feed portion 53, and the second radiating portion 56 are orderly arranged between the first gap 5112 and the second 5114.

Figure 18:
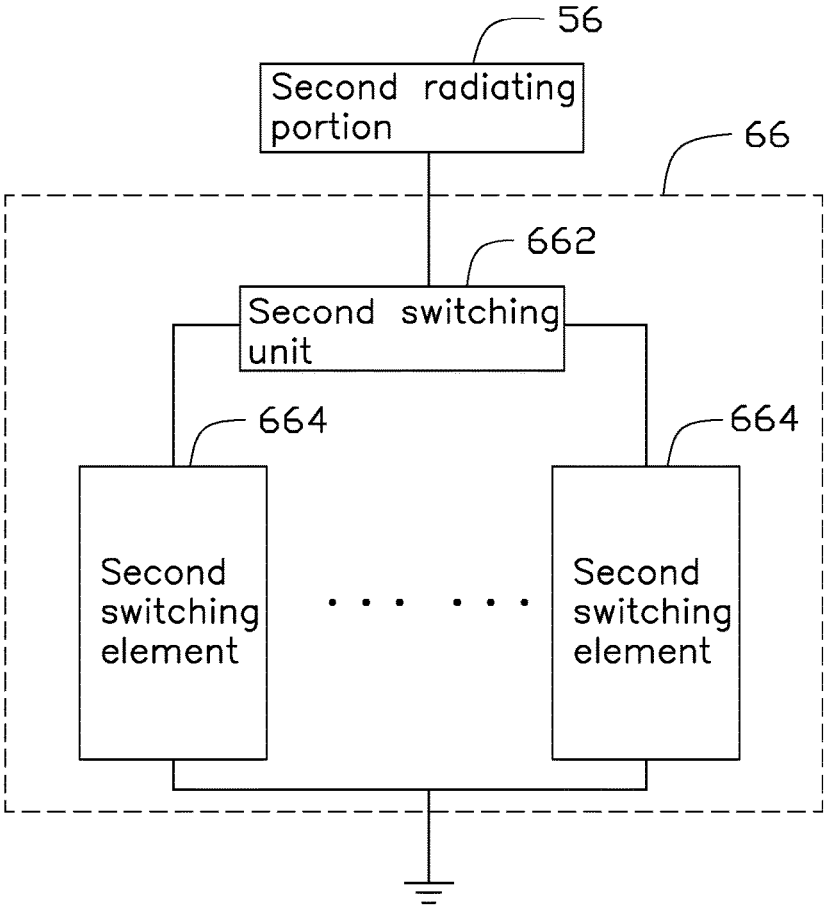
FIG. 18 is a circuit diagram of a second switching circuit of the antenna structure of FIG. 12.

The second switching circuit 66 is structurally similar with the first switching circuit 64. The first switching circuit 64 and the second switching circuit 66 are both arranged on the printed circuit board 610. Per FIG. 18, the second switching circuit 66 includes a second switching unit 662 and a plurality of second switching elements 664. The second switching unit 662 is electrically connected to the second feed portion 56. The second switching elements 664 can be an inductor, a capacitor, or a combination of the inductor and the capacitor. The second switching elements 664 are connected in parallel to each other. One end of each switching element 664 is electrically connected to the second switching unit 662. The other end of each switching element 664 is electrically connected to the ground. Through controlling the second switching unit 662, the long portion B1 can be switched to connect with different second switching elements 664. Each second switching element 664 has a different impedance.

The first feed portion 53 feeds current into the radiating section 52 from the feed source 68 through the matching circuit 62. The current flows through the long portion B1 and towards the first gap 5112, further flows through the first radiating portion 55, thus activating a first mode to generate radiation signals in a first frequency band. In this exemplary embodiment, the first mode is an LTE-A (Long Term Evolution Advanced) low frequency operation mode, the first frequency band is a frequency band of about 700-960 MHz. The first feed portion 53 feeds current into the radiating section 52, the current flows towards the first ground portion 54 and the first switching circuit 64, thus activating a second mode to generate radiation signals in a second frequency band. In this exemplary embodiment, the second mode is an LTE-A middle frequency operation mode, the second frequency band is a frequency band of about 1710-2170 MHz. The first feed portion 53 feeds current into the radiating section 52, the current flows through the short portion B2 and towards the second gap 5114, and further flows through the second radiating portion 56 and the second switching circuit 66, thus activating a third mode to generate radiation signals in a third frequency band. In this exemplary embodiment, the third mode is an LTE-A high frequency operation mode, the third frequency band is a frequency band of about 2300-2690 MHz.

Through controlling the first switching unit 642, the long portion B1 can be switched to connect with different first switching elements 644; through controlling the second switching unit 662, the short portion B2 can be switched to connect with different second switching elements 664. Since each first switching element 644 and each second switching element 664 has a different impedance, operating frequency bands of the long portion B1 and the short portion B2 can be adjusted through switching the first switching unit 642 and the second switching unit 662, for example, the first frequency band and the third frequency band can be offset towards a lower frequency or towards a higher frequency (relative to each other).

In this exemplary embodiment, when the first switching unit 642 is in an open circuit state, the second switching unit 662 is switched to connect to the second switching element 664 with an inductance of 2 nH, the antenna structure 500 operates the LTE-A low frequency band of 700 MHz and the LTE-A high frequency band of 1710-1880 MHz. When the first switching unit 642 is switched to connect to the first switching element 644 with an inductance of 39 nH, the second switching unit 662 is switched to connect to the second switching element 664 with an inductance of 2 nH, the antenna structure 500 operates the LTE-A low frequency band of 850 MHz. When the first switching unit 642 is switched to connect to the first switching element 644 with an inductance of 18 nH, the second switching unit 662 is switched to connect to the second switching element 664 with an inductance of 2 nH, the antenna structure 500 operates the LTE-A low frequency band of 900 MHz. When the first switching unit 642 is switched to connect to the first switching element 644 with an inductance of 4.3 nH, the second switching unit 662 is switched to connect to the second switching element 664 with an inductance of 33 nH, the antenna structure 500 operates the LTE-A high frequency band of 1850-1990 MHz. When the first switching unit 642 is switched to connect to the first switching element 644 with an inductance of 4.3 nH, the second switching unit 662 is switched to connect to the second switching element 664 with an inductance of 2.8 nH, the antenna structure 500 operates the LTE-A high frequency band of 1920-2170 MHz. When the first switching unit 642 is switched to connect to the first switching element 644 with an inductance of 4.3 nH, the second switching unit 662 is switched to connect to the second switching element 664 with an inductance of 0.6 nH, the antenna structure 500 operates the LTE-A high frequency band of 2300-2400 MHz. When the first switching unit 642 is switched to connect to the first switching element 644 with an inductance of 4.3 nH, the second switching unit 662 is switched to connect to the second switching element 664 with an inductance of 0.3 nH, the antenna structure 500 operates the LTE-A high frequency band of 2500-2700 MHz.

The third radiating portion 57 includes a first arm 572, a second arm 574, and a third arm 576 connected in that order. The first arm 572, the second arm 574, and the third arm 576 are in a same plane. The first arm 572 and the third arm 576 are both substantially L-shaped and connect to the opposite ends of the second arm 574. The second arm 574 is a substantially straight arm and parallel to the first radiating portion 55. The second feed portion 58 and the second ground portion 59 are both straight arms and in parallel. One end of the second feed portion 58 electrically connects to a conjunction of the first arm 572 and the second arm 574, the other end electrically connects to the feed source 68. One end of the second ground portion 59 perpendicularly connects to the second arm 574 and is adjacent to the first arm 572, the other end electrically connects to ground. The second feed portion 58 feeds current into the third radiating portion 57 from the feed source 68, the current flows through the second arm 574 and the third arm 576, thus activating a fourth mode to generate radiation signals in a fourth frequency band. In this exemplary embodiment, the fourth mode is a WiFi 2.4G mode, the fourth frequency band is a frequency band of about 2400-2485 MHz. The current is fed into the third radiating portion 57, the current flows through the first arm 572, thus activating a fifth mode to generate radiation signals in a fifth frequency band. In this exemplary embodiment, the fifth mode is a WiFi 5G mode, the fifth frequency band is a frequency band of about 5150-5850 MHz.

The backboard 512 serves as the ground of the antenna structure 500. Perhaps, a middle frame or a shielding mask (not shown) also may serves as the ground of the antenna structure 500, the middle frame can be a shielding mask for shielding electromagnetic interference arranged on the display 601 facing the backboard 512. The shielding mask or the middle frame can be made of metal material. The shielding mask or the middle frame may connect to the backboard 512 to form a greater ground for the antenna structure 500. In summary, each ground portion directly or indirectly connects to the ground.

In this exemplary embodiment, to obtain preferred antenna characteristics, a thickness of the wireless communication device 600 is 7.43 millimeter. A width of the slot 518 can be 4.43 millimeter, that is a distance from the backboard 512 to the first radiating section 62, the second radiating section 64, and third radiating section 66 can be 4.43 millimeter, the width of the slot 518 can be adjusted from 3 to 4.5 millimeter, thus to improve antenna characteristic for the radiating sections by being spaced apart from the backboard 512. A width of each of the gaps 5112, 5114 can be 2 millimeter and can be adjusted from 1.5 to 2.5 millimeter, which may further improve antenna characteristic for the radiating sections. A thickness of the front frame 111 can be 2 millimeter, that is a thickness of the gaps 5112, 5114 can be 2 millimeter.

Figure 15:
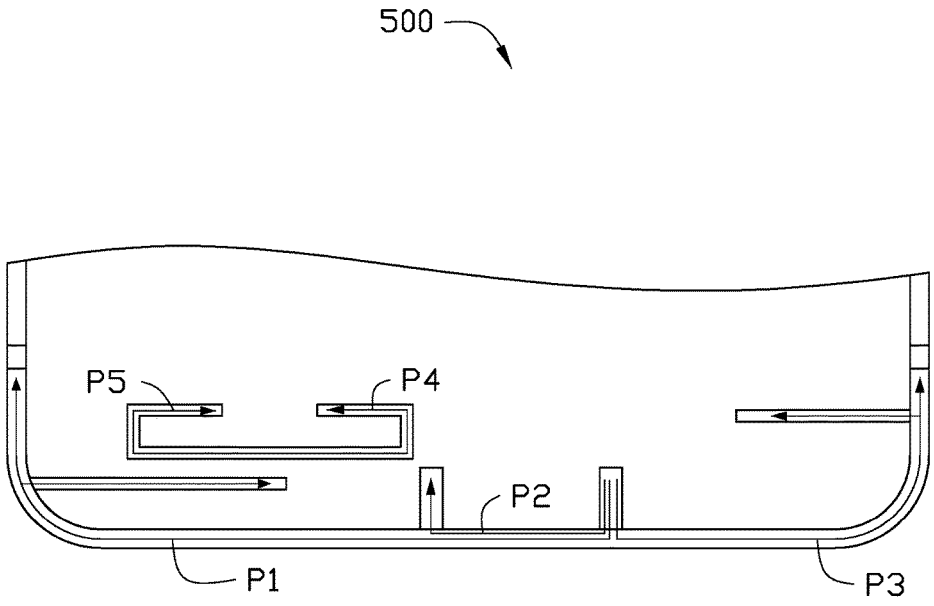
FIG. 15 is a current path distribution graph when the antenna structure of FIG. 12 is in operation.

Per FIG. 15, when the current enters the radiating section 52 from the first feed portion 53, the current flows towards two direction, one direction flows through the long portion B1 and towards the first gap 5112, and flows through the first radiating portion 55 (please see a path P1), thus, activating the LTE-A low frequency operation mode (700-960 MHz). When the current enters the radiating section 52 from the first feed portion 53, flows through the ground portion 54

(please see a path P2), thus, activating the LTE-A middle frequency operation mode (1710-2170 MHz). When the current enters the radiating section 52 from the first feed portion 53, another direction flows through the short portion B2 and towards the second gap 5114, and flows through the second radiating portion 56 (please see a path P3), thus, activating the LTE-A high frequency operation mode (2300-2690 MHz). When the current enters the third radiating portion 57 from the second feed portion 58, the current flows towards two direction, one direction flows through the second arm 574 and the third arm 576 (please see a path P4), thus, activating the WiFi 2.4G mode (2400-2485 MHz). When the current enters the third radiating portion 57 from the second feed portion 58, the other direction flows through the first arm 572 (please see a path P5), thus, activating the WiFi 5G mode (5150-5850 MHz).

The first feed portion 53 and the first ground portion 54 are on opposite sides of the USB connector 603. The first radiating portion 55 and the third radiating portion 57 are above the audio jack 602 and spaced apart from each other. The second radiating portion 56 is between the speaker 607 and the bottom arm of the front frame 511.

Figure 19:
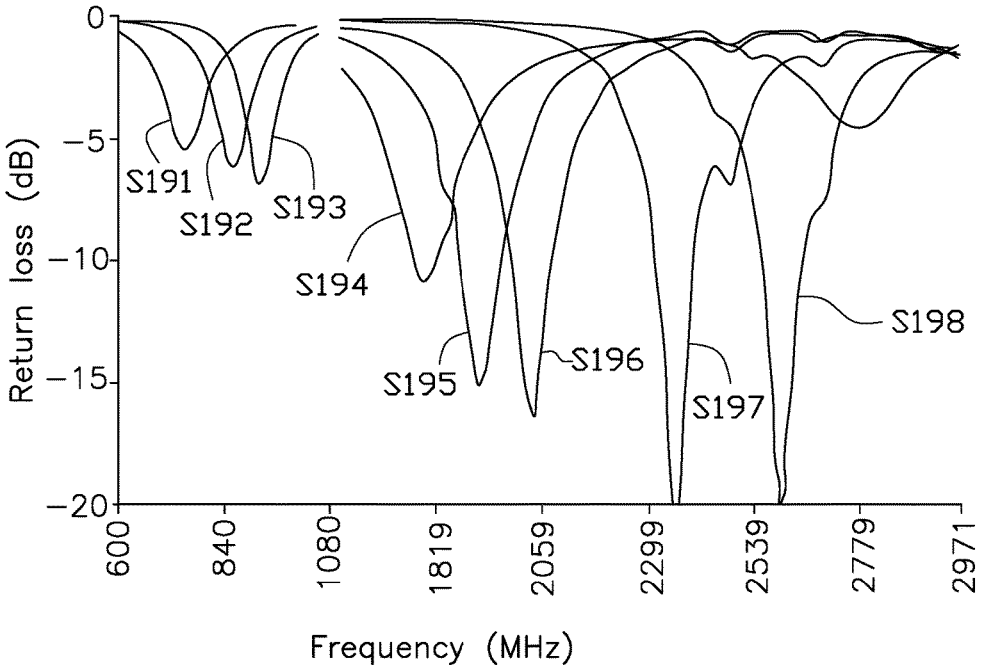
FIG. 19 is a return loss (RL) graph when the antenna structure of FIG. 12 operates at an LTE-A low frequency band, an LTE-A middle frequency band, and an LTE-A high frequency band.

FIG. 19 illustrates a return loss (RL) graph when the antenna structure 500 operates at the LTE-A low frequency band, the LTE-A middle frequency band, and the LTE-A high frequency band. Curve S191 illustrates a return loss when the antenna structure 500 operates at the LTE-A low frequency band of 700 MHz. Curve S192 illustrates a return loss when the antenna structure 500 operates at the LTE-A low frequency band of 850 MHz. Curve S193 illustrates a return loss when the antenna structure 500 operates at the LTE-A low frequency band of 900 MHz. Curve S194 illustrates a return loss when the antenna structure 500 operates at the LTE-A middle frequency band of 1710-1880 MHz. Curve S195 illustrates a return loss when the antenna structure 500 operates at the LTE-A high frequency band of 1850-1990 MHz. Curve S196 illustrates a return loss when the antenna structure 500 operates at the LTE-A high frequency band of 1920-2170 MHz. Curve S197 illustrates a return loss when the antenna structure 500 operates at the LTE-A high frequency band of 2300-2400 MHz. Curve S198 illustrates a return loss when the antenna structure 500 operates at the LTE-A high frequency band of 2500-2700 MHz.

Figure 20:
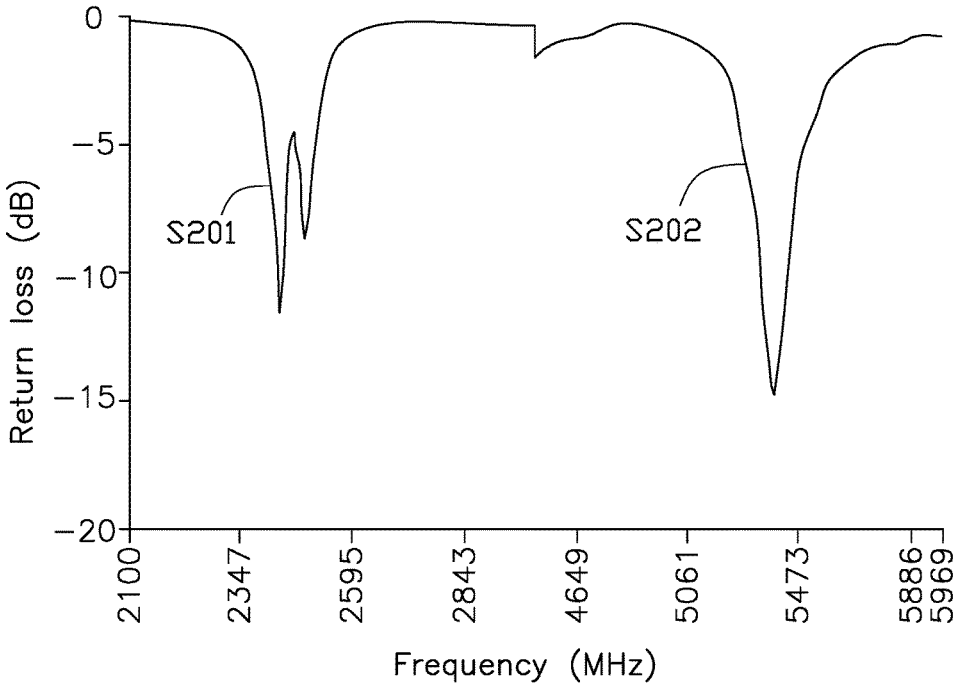
FIG. 20 is a return loss (RL) graph when the antenna structure of FIG. 12 operates at a WiFi 2.4G frequency band and a WiFi 5G frequency band.

FIG. 20 illustrates a return loss (RL) graph when the antenna structure 500 operates at the WiFi 2.4G frequency band and the WiFi 5G frequency band. Curve S201 illustrates a return loss when the antenna structure 500 operates at the WiFi 2.4G frequency band of 2400-2485 MHz. Curve S202 illustrates a return loss when the antenna structure 500 operates at the WiFi 5G frequency band of 5150-5850 MHz.

FIG. 21 illustrates a radiating efficiency graph when the antenna structure 500 operates at the LTE-A low frequency operation mode, the LTE-A middle frequency band, and the LTE-A high frequency band. Curve S211 illustrates a radiating efficiency when the antenna structure 500 operates at the LTE-A low frequency band of 700 MHz. Curve S212 illustrates a radiating efficiency when the antenna structure 500 operates at the LTE-A low frequency band of 850 MHz. Curve S213 illustrates a radiating efficiency when the antenna structure 500 operates at the LTE-A low frequency band of 900 MHz. Curve S214 illustrates a radiating efficiency when the antenna structure 500 operates at the LTE-A middle frequency band of 1710-1880 MHz. Curve S215 illustrates a radiating efficiency when the antenna structure 500 operates at the LTE-A high frequency band of 1850-1990 MHz. Curve S216 illustrates a radiating efficiency when the antenna structure 500 operates at the LTE-A high frequency band of 1920-2170 MHz. Curve S217 illustrates a radiating efficiency when the antenna structure 500 operates at the LTE-A high frequency band of 2300-2400 MHz. Curve S218 illustrates a radiating efficiency when the antenna structure 500 operates at the LTE-A high frequency band of 2500-2700 MHz.

Figure 22:
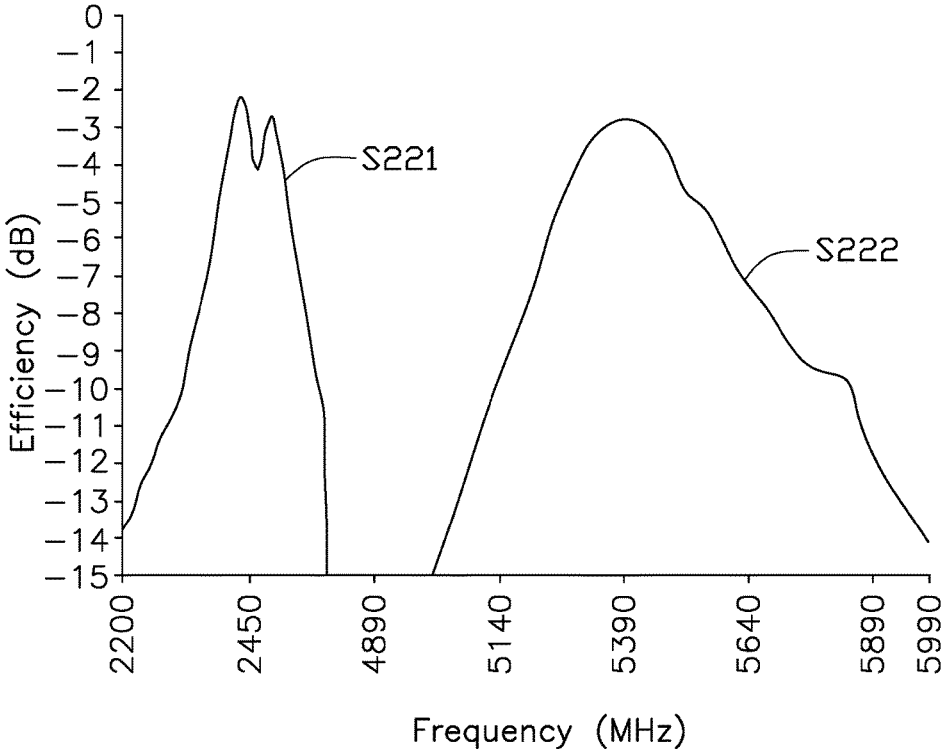
FIG. 22 is a radiating efficiency graph when the antenna structure of FIG. 12 operates at the WiFi 2.4G frequency band and the WiFi 5G frequency band.

FIG. 22 illustrates radiating efficiency graph when the antenna structure 500 operates at the WiFi 2.4G frequency band and the WiFi 5G frequency band. Curve S221 illustrates a radiating efficiency when the antenna structure 500 operates at the WiFi 2.4G frequency band of 2400-2485 MHz. Curve S222 illustrates a radiating efficiency when the antenna structure 500 operates at the WiFi 5G frequency band of 5150-5850 MHz.

The antenna structure 500 can work at the LTE-A low frequency band (700-960 MHz), at the middle frequency band (1710-2170 MHz), at the high frequency band (2300-2690 MHz), at the WiFi 2.4G frequency band (2400-2485 MHz), and at the WiFi 5G frequency band (5150-5850 MHz), and when the antenna structure 500 operates at these frequency bands, a working frequency satisfies a design of the antenna and also has a good radiating efficiency.

The antenna structure 500 includes the metallic member 51 and the backboard 512. The metallic member 51 defines the slot on the side frame 513 and the gaps on the front frame 511. The backboard 512 is an integrally formed metallic sheet without other slot, break line, and/or gap, which maintains integrity and aesthetics.

The antenna structure 100 of the first exemplary embodiment can be an upper antenna and the antenna structure 500 of the second exemplary embodiment can be a lower antenna of a wireless communication device. The upper antenna of the first exemplary embodiment and the lower antenna of the second exemplary embodiment may cooperatively form a combination antenna for the wireless communication device. The wireless communication device may transmit wireless signals by the lower antenna, and receive wireless signals by the upper antenna and the lower antenna.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a metallic member, the metallic member comprising a front frame, a backboard, and a side frame, the side frame being between the front frame and the backboard;

a first feed portion;

a first ground portion;

a first radiating portion; and a second radiating portion;

wherein the side frame defines a slot;

wherein the front frame defines a first gap and a second gap, the first gap and the second gap are on two opposite ends of the slot, the first gap and the second gap are in communication with the slot and extend across the front frame;

wherein a portion of the front frame between the first gap and the second gap forms a radiating section; the first radiating portion and the second radiating portion are connected to opposite ends of the radiating section and adjacent to the first gap and the second gap, respectively, the first feed portion and the first ground portion are electrically connected to the radiating section, the first ground portion is between the first gap and the first feed portion; and wherein current enters the radiating section from the first feed portion, the current flows through the radiating section and towards the first gap and the first radiating portion, thus activating radiating signals in a first frequency band; the current flows through the radiating section and towards the first ground portion, thus activating radiating signals in a second frequency band; the current flows through the radiating section and towards the second gap and the second radiating portion, thus activating radiation signals in a third different frequency band; frequencies of the second frequency band is higher than frequencies of the first frequency band, and frequencies of the third frequency band is higher than frequencies of the second frequency band.

2. The antenna structure of claim 1, wherein the slot and the gaps are all filled with insulating material.

3. The antenna structure of claim 1, wherein the side frame includes a bottom portion, a first side portion and a second side portion, the first side portion and the second side portion are on two opposite sides of the top portion, the slot is defined on the top portion and extends from the top portion to the first side portion and the second side portion of the side frame.

4. The antenna structure of claim 1, further comprising a matching circuit, a first switching circuit and a second switching circuit, wherein one end of the first feed portion connects to the radiating section and is adjacent to the second gap, the other end electronically connects to a feed source through the matching circuit; the radiating section is divided into a short portion and a long portion by a connecting point of the first feed portion, the long portion extends towards the first gap and the short portion extends towards the second gap from the connecting point of the first feed portion; the long portion is longer than the short portion.

5. The antenna structure of claim 4, wherein the first ground portion is spaced apart from the first feed portion; one end of the first ground portion electrically connects to the long portion, the other end electrically connects to the ground through the first switching circuit.

6. The antenna structure of claim 4, wherein the matching circuit includes a first capacitor, a first inductor, and a second inductor; one end of the first inductor electrically connects to the first feed portion, the other end electrically connects to the feed source; one end of the second inductor is electrically connected between the first inductor and the first feed portion, the other end electrically connects to the ground; one end of the first capacitor is electrically connected between the first inductor and the feed source, the other end electrically connects to the ground.

7. The antenna structure of claim 4, wherein the first radiating portion electrically connects to the long portion and is adjacent to the first gap, the first radiating portion is substantially a straight arm, the first radiating portion electrically connects to a side arm of the front frame defining the first gap and is parallel to the bottom arm of the front frame.

8. The antenna structure of claim 4, wherein one end of the second radiating portion electrically connects to the short portion and is adjacent to the second gap, the other end electrically connects to the ground through the second switching circuit, the second radiating portion is substantially L-shaped and connects to the side arm of the front frame defining the second gap and is parallel to the bottom arm of the front frame.

9. The antenna structure of claim 4, wherein the first switching circuit includes a first switching unit and a plurality of first switching elements; the first switching unit is electrically connected to the first ground portion; the first switching elements are an inductor, a capacitor, or a combination of the inductor and the capacitor; the first switching elements are connected in parallel to each other; one end of each switching element is electrically connected to the first switching unit; the other end of each switching element is electrically connected to the ground; through controlling the first switching unit, the long portion is switched to connect with different first switching elements; each first switching element has a different impedance.

10. The antenna structure of claim 9, wherein the second switching circuit includes a second switching unit and a plurality of second switching elements; the second switching unit is electrically connected to the second feed portion; the second switching elements are an inductor, a capacitor, or a combination of the inductor and the capacitor; the second switching elements are connected in parallel to each other; one end of each switching element is electrically connected to the second switching unit; the other end of each switching element is electrically connected to the ground; through controlling the second switching unit, the long portion is switched to connect with different second switching elements; each second switching element has a different impedance.

11. The antenna structure of claim 10, wherein the first feed portion feeds current into the radiating section from the feed source through the matching circuit, the current flows through the long portion and towards the first gap, further flows through the first radiating portion, thus activating a first mode to generate radiation signals in a first frequency band, the first mode is an LTE-A (Long Term Evolution Advanced) low frequency operation mode, the first frequency band is a frequency band of about 700-960 MHz.

12. The antenna structure of claim 11, wherein the first feed portion feeds current into the radiating section, the current flows towards the first ground portion and the first switching circuit, thus activating a second mode to generate radiation signals in a second frequency band, the second mode is an LTE-A middle frequency operation mode, the second frequency band is a frequency band of about 1710-2170 MHz.

13. The antenna structure of claim 12, wherein the first feed portion feeds current into the radiating section, the current flows through the short portion and towards the second gap, and further flows through the second radiating portion and the second switching circuit, thus activating a third mode to generate radiation signals in a third frequency band, the third mode is an LTE-A high frequency operation mode, the third frequency band is a frequency band of about 2300-2690 MHz.

14. The antenna structure of claim 13, wherein through controlling the first switching unit, the long portion is switched to connect with different first switching elements;

through controlling the second switching unit, the short portion is switched to connect with different second switching elements; since each first switching element and each second switching element has a different impedance, operating frequency bands of the long portion and the short portion are adjusted through switching the first switching unit and the second switching unit, the first frequency band and the third frequency band are offset towards a lower frequency or towards a higher frequency (relative to each other).

15. The antenna structure of claim 1, further comprising a third radiating portion, a second feed portion, and a second ground portion, wherein the third radiating portion includes a first arm, a second arm, and a third arm connected in that order; the first arm, the second arm, and the third arm are in a same plane; the first arm and the third arm are both substantially L-shaped and connect to the opposite ends of the second arm; the second arm is a substantially straight arm and parallel to the first radiating portion; the second feed portion and the second ground portion are both straight arms and in parallel; one end of the second feed portion electrically connects to a conjunction of the first arm and the second arm, the other end electrically connects to the feed source; one end of the second ground portion perpendicularly connects to the second arm and is adjacent to the first arm, the other end electrically connects to ground.

16. The antenna structure of claim 15, wherein The second feed portion feeds current into the third radiating portion from the feed source, the current flows through the second arm and the third arm, thus activating a fourth mode to generate radiation signals in a fourth frequency band, the fourth mode is a WiFi 2.4G mode, the fourth frequency band is a frequency band of about 2400-2485 MHz; the current is fed into the third radiating portion, the current flows through the first arm, thus activating a fifth mode to generate radiation signals in a fifth frequency band, the fifth mode is a WiFi 5G mode, the fifth frequency band is a frequency band of about 5150-5850 MHz.

17. The antenna structure of claim 1, wherein a width of the slot is from 3 to 4.5 millimeters, a distance from the backboard to the first radiating section, the second radiating section, and the third radiating section is from 3 to 4.5 millimeters, a width of each of the gaps is from 1.5 to 2.5 millimeters.

18. The antenna structure of claim 1, wherein the backboard is an integral and single metallic sheet, the backboard is directly connected to the side frame and there is no gap formed between the backboard and the side frame, the backboard does not define any slot, break line, or gap that divides the backboard.

19. A wireless communication device, comprising:

an antenna structure, the antenna structure comprising:

a metallic member, the metallic member comprising a front frame, a backboard, and a side frame, the side frame being between the front frame and the backboard;

a first feed portion;

a first ground portion;

a first radiating portion; and a second radiating portion;

wherein the side frame defines a slot;

wherein the front frame defines a first gap and a second gap, the first gap and the second gap are on two opposite ends of the slot, the first gap and the second gap are in communication with the slot and extend across the front frame;

wherein a portion of the front frame between the first gap and the second gap forms a radiating section; the first radiating portion and the second radiating portion are connected to opposite ends of the radiating section and adjacent to the first gap and the second gap, respectively, the first feed portion and the first ground portion are electrically connected to the radiating section, the first ground portion is between the first gap and the first feed portion; and wherein current enters the radiating section from the first feed portion, the current flows through the radiating section and towards the first gap and the first radiating portion, thus activating radiating signals in a first frequency band; the current flows through the radiating section and towards the first ground portion, thus activating radiating signals in a second frequency band; the current flows through the radiating section and towards the second gap and the second radiating portion, thus activating radiation signals in a third different frequency band; frequencies of the second frequency band is higher than frequencies of the first frequency band, and frequencies of the third frequency band is higher than frequencies of the second frequency band.

20. The wireless communication device of claim 19, further comprising an audio jack, a USB connector, and a speaker, wherein the first feed portion and the first ground portion are on opposite sides of the USB connector; the first radiating portion and the third radiating portion are above the audio jack and spaced apart from each other; the second radiating portion is between the speaker and the bottom arm of the front frame.

* * * * *